US012103741B2

(12) United States Patent
Trevino

(10) Patent No.: US 12,103,741 B2
(45) Date of Patent: Oct. 1, 2024

(54) HINGED TUB COVERING DEVICE

(71) Applicant: Samuel Trevino, Flowersville, TX (US)

(72) Inventor: Samuel Trevino, Flowersville, TX (US)

( * ) Notice: Subject to any disclaimer, the term of this patent is extended or adjusted under 35 U.S.C. 154(b) by 0 days.

(21) Appl. No.: 18/071,122

(22) Filed: Nov. 29, 2022

(65) Prior Publication Data

US 2024/0174410 A1 May 30, 2024

(51) Int. Cl.

| | |
|---|---|
| ***B65D 47/08*** | (2006.01) |
| ***B65D 43/02*** | (2006.01) |
| ***B65D 43/16*** | (2006.01) |

(52) U.S. Cl.

CPC ..... *B65D 47/08* (2013.01); *B65D 43/0222* (2013.01); *B65D 43/165* (2013.01); *B65D 2543/00092* (2013.01); *B65D 2543/00351* (2013.01); *B65D 2543/00537* (2013.01); *B65D 2543/00731* (2013.01); *B65D 2543/00796* (2013.01); *B65D 2543/00851* (2013.01); *B65D 2543/00972* (2013.01)

(58) Field of Classification Search

CPC .. B65D 43/161; B65D 43/163; B65D 43/165; B65D 2543/00351; B65D 47/08; B65D 47/0823; B65D 51/247

See application file for complete search history.

(56) References Cited

U.S. PATENT DOCUMENTS

| | | | | |
|---|---|---|---|---|
| 1,173,134 | A * | 2/1916 | Whitney | B65D 51/246 220/831 |
| 6,073,795 | A * | 6/2000 | Longstreth | B65D 43/021 220/756 |
| D626,790 | S | 11/2010 | Gibson | |
| 10,427,844 | B2 | 10/2019 | Kovitz | |
| 2014/0217096 | A1* | 8/2014 | Simpson | B65D 43/0212 220/780 |
| 2014/0299598 | A1* | 10/2014 | Irani | B65D 50/00 220/212 |
| 2018/0072469 | A1* | 3/2018 | Bloom | B65D 43/165 |
| 2018/0127163 | A1* | 5/2018 | Choi | B65D 47/0857 |
| 2020/0140154 | A1* | 5/2020 | Taylor | B65D 50/045 |

FOREIGN PATENT DOCUMENTS

| | | |
|---|---|---|
| KR | 2020110010832 | 11/2011 |
| KR | 2020120008972 | 12/2012 |
| KR | 101761770 | 7/2017 |

* cited by examiner

*Primary Examiner* — Jeffrey R Allen

(57) ABSTRACT

A hinged tub covering device for covering a popcorn container includes a ring with a groove extending circumferentially around its inner face. The groove is sized and shaped complementarily to a lip of a top of a container and enter into snap fit engagement with the lip to removably attach the ring to the container. A domed cover is hingedly attached to the ring and selectively closes the top of the container. When the domed cover closed, it retains popcorn within the container, and, when open, the popcorn can be added to the container and is accessible to a user. A cutout is positioned in the domed cover and is selectively closable by means of a flap, which is hingedly attached to the domed cover. When closed, the flap retains the popcorn within the container, and when open, a flavoring agent can be added to the container.

9 Claims, 7 Drawing Sheets

HINGED TUB COVERING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to tub covers and more particularly pertains to a new tub cover for covering a popcorn container. The present invention discloses a tub cover that can be hinged open to add popcorn and then hinged closed to prevent spillage of the popcorn.

(2) Description of Related Art Including Information Disclosed Under 37 CFR 1.97 and 1.98

The prior art relates to tub covers, which may comprise planar lids, lids comprising a plurality of flaps, and domed lids with handles. Related prior art comprises domed lids for food packaging. What is lacking in the prior art is a tub cover comprising a ring to which a domed cover is hingedly attached. The ring can be snap fit to a lip of a container, with the domed lid then being hingable between open and closed configurations. A cutout in an upper end of the domed cover is configured for addition of butter and is closable by a flap.

BRIEF SUMMARY OF THE INVENTION

An embodiment of the disclosure meets the needs presented above by generally comprising a ring, which has a groove positioned in its inner face, with the groove extending circumferentially around the ring. The groove is sized and shaped complementarily to a lip that is attached to a circumference of a top of a container. The groove is configured for snap fit engagement with the lip to removably attach the ring to the container. A domed cover is hingedly attached to the ring and is selectively hingable between a closed configuration, wherein the domed cover is configured to retain popcorn within the container, and an open configuration, wherein the popcorn can be added to the container and wherein the popcorn is accessible to a user. A cutout is positioned in an upper end of the domed cover. A flap is hingedly attached to the domed cover and is selectively hingable between a closed position over the cutout, wherein the flap is configured to retain the popcorn within the container, and an open position, wherein the cutout is configured for addition of a flavoring agent to the container.

Another embodiment of the disclosure includes a hinged tub covering system, which comprises a container having a lip attached to its circumference. The hinged tub covering system also comprises a hinged tub covering device, as described in the disclosure above. A ring of the hinged tub covering device is attached to the container by means of the lip being in snap fit engagement with a groove in the ring. The hinged tub covering system also may include popcorn in the container.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
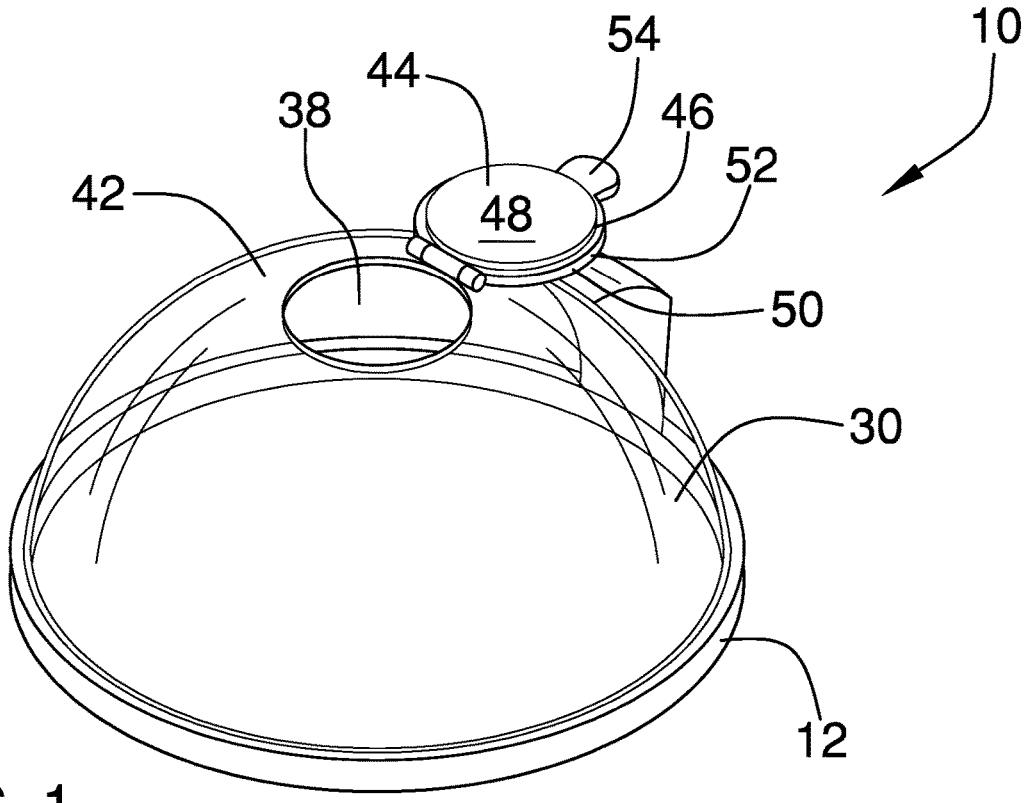
FIG. 1 is a front isometric perspective view of a hinged tub covering device according to an embodiment of the disclosure.
Figure 2:
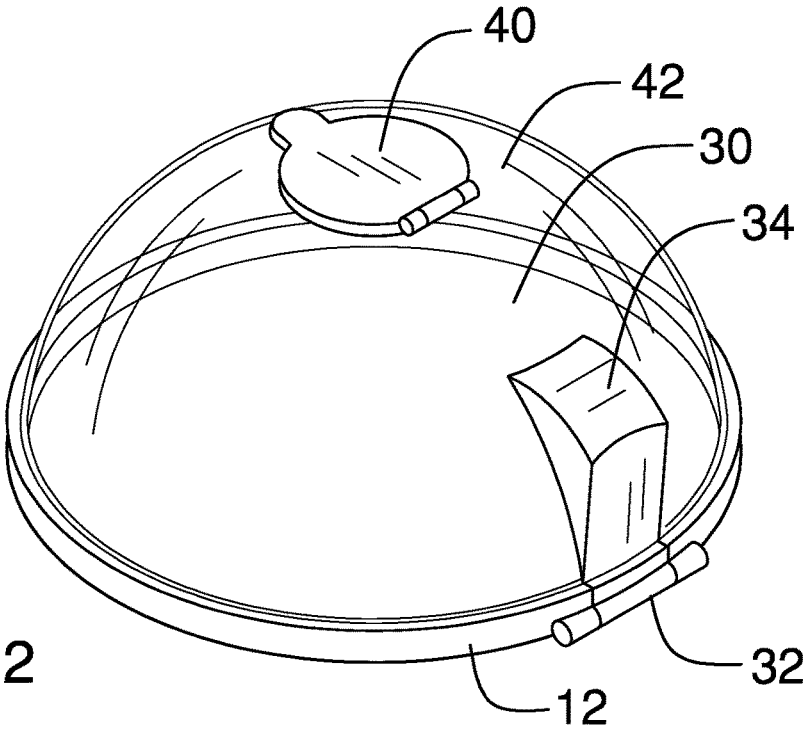
FIG. 2 is a rear isometric perspective view of an embodiment of the disclosure.

With reference now to the drawings, and in particular to FIGS. 1 through 9 thereof, a new tub cover embodying the principles and concepts of an embodiment of the disclosure and generally designated by the reference numeral 10 will be described.

Figure 3:
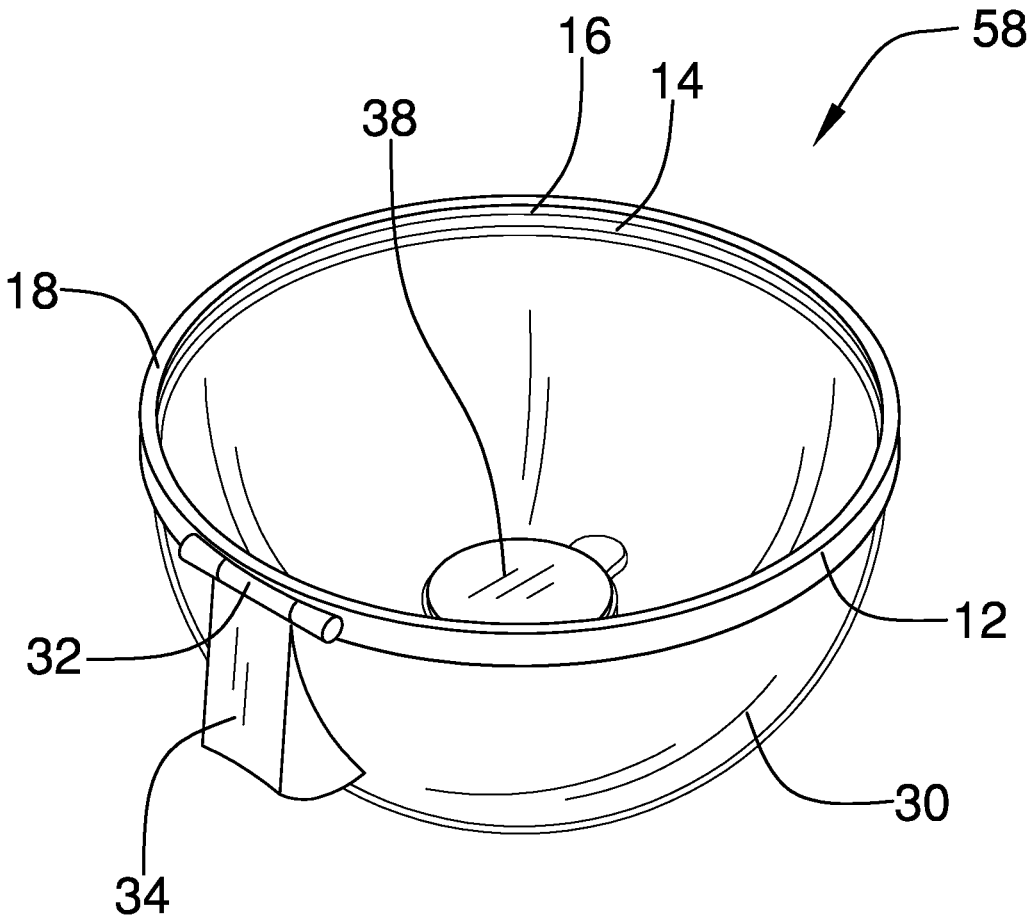
FIG. 3 is a bottom isometric perspective view of an embodiment of the disclosure.
Figure 4:
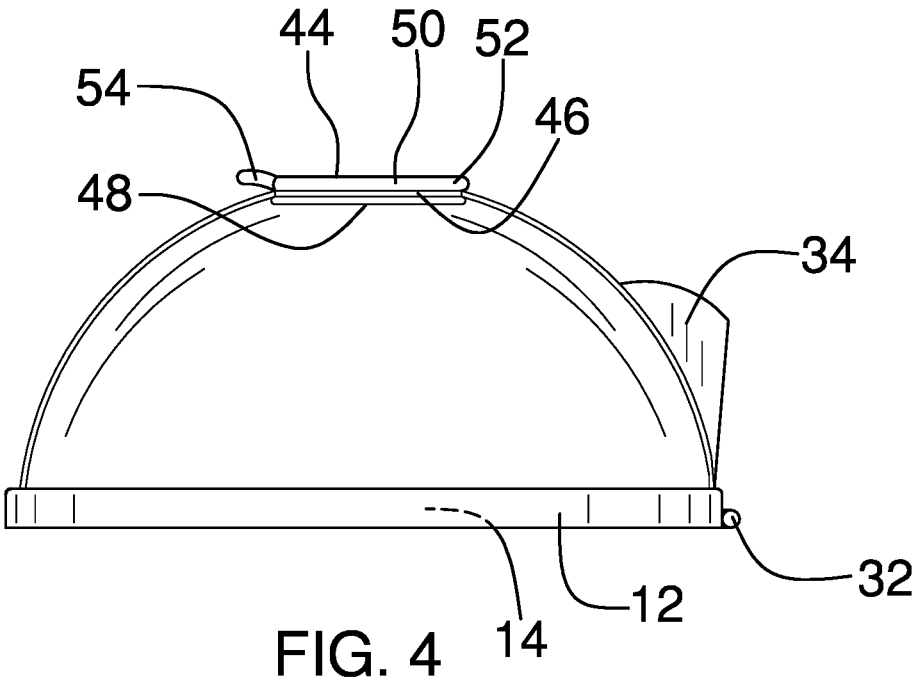
FIG. 4 is a side view of an embodiment of the disclosure.
Figure 5:
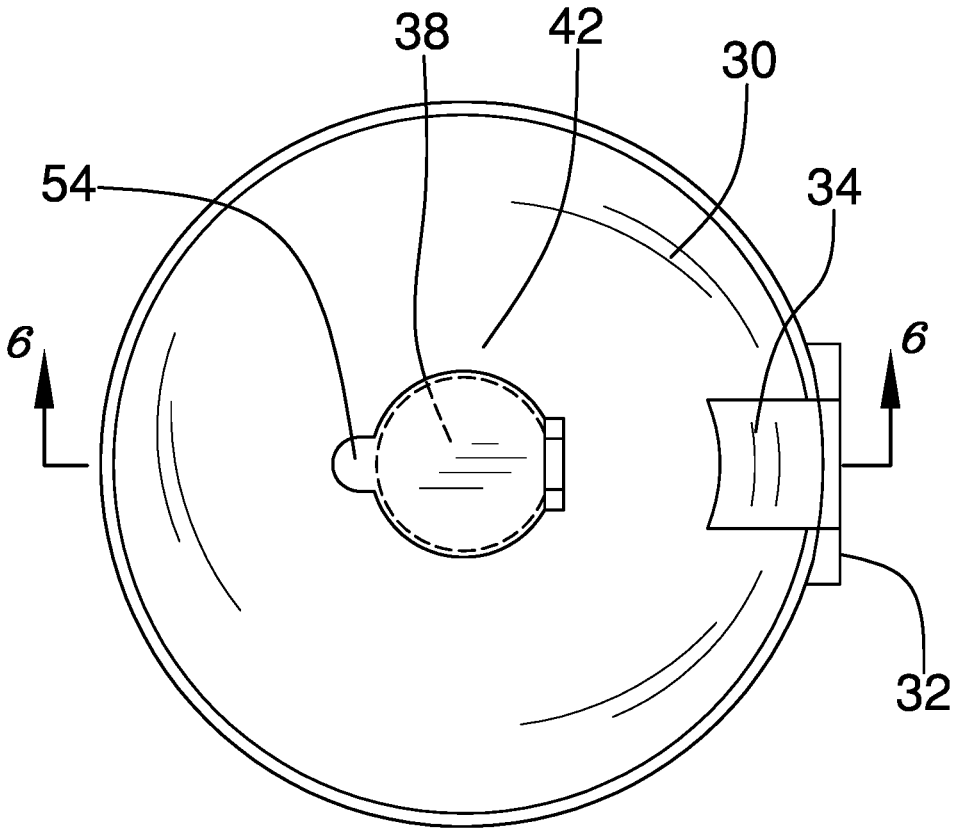
FIG. 5 is a top view of an embodiment of the disclosure.
Figure 6:
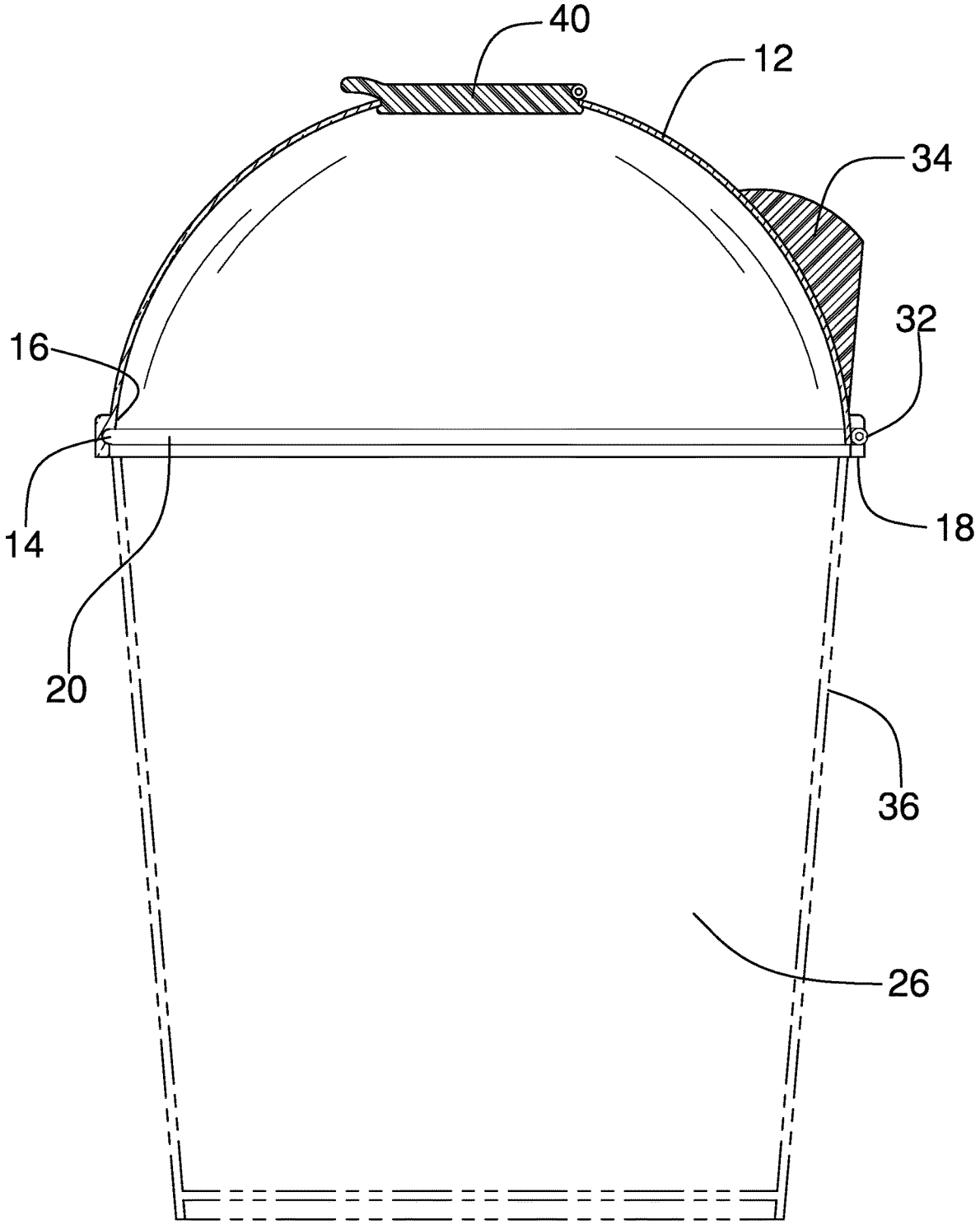
FIG. 6 is a cross-sectional view of an embodiment of the disclosure.
Figure 7:
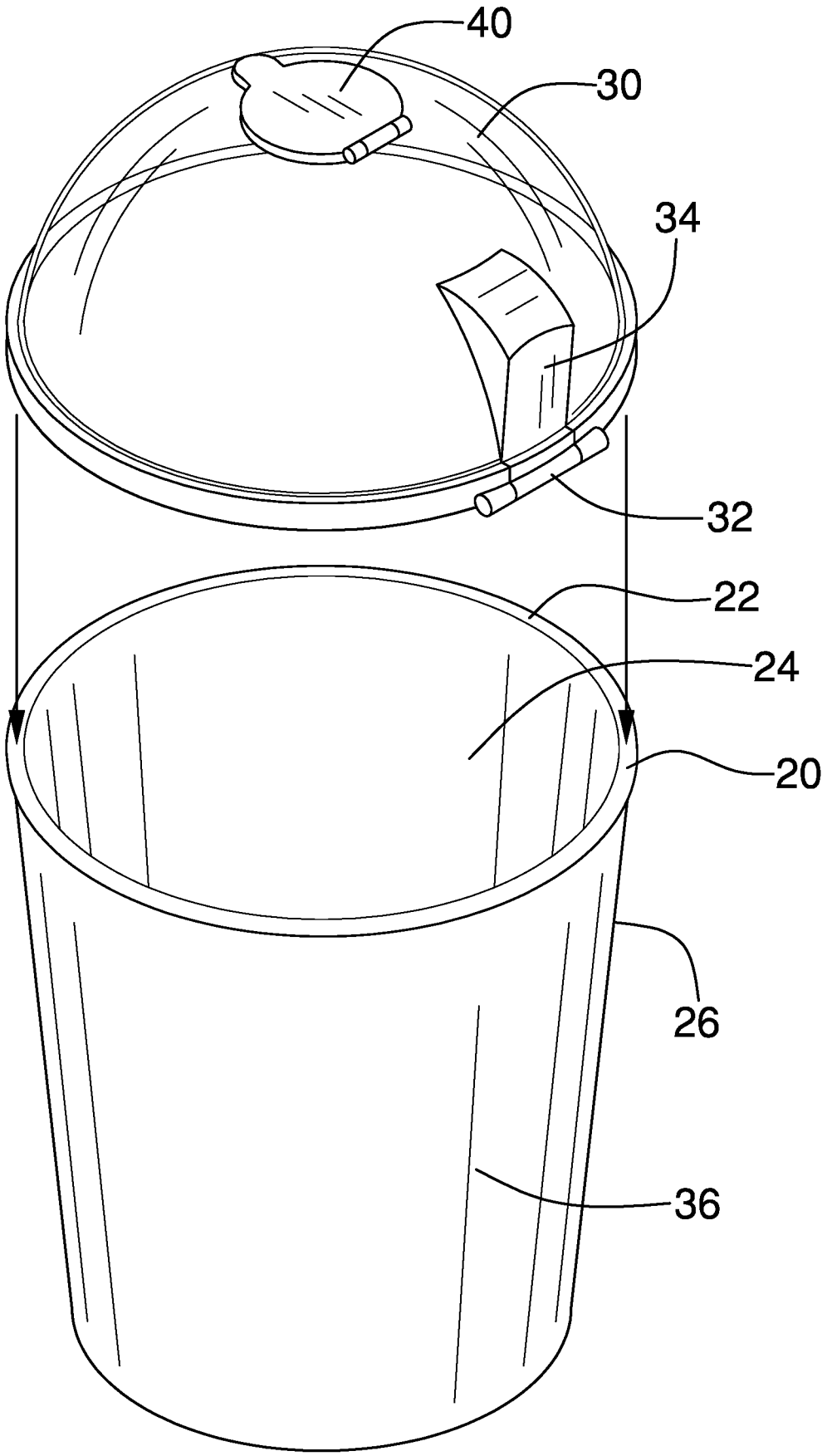
FIG. 7 is an in-use view of an embodiment of the disclosure.
Figure 8:
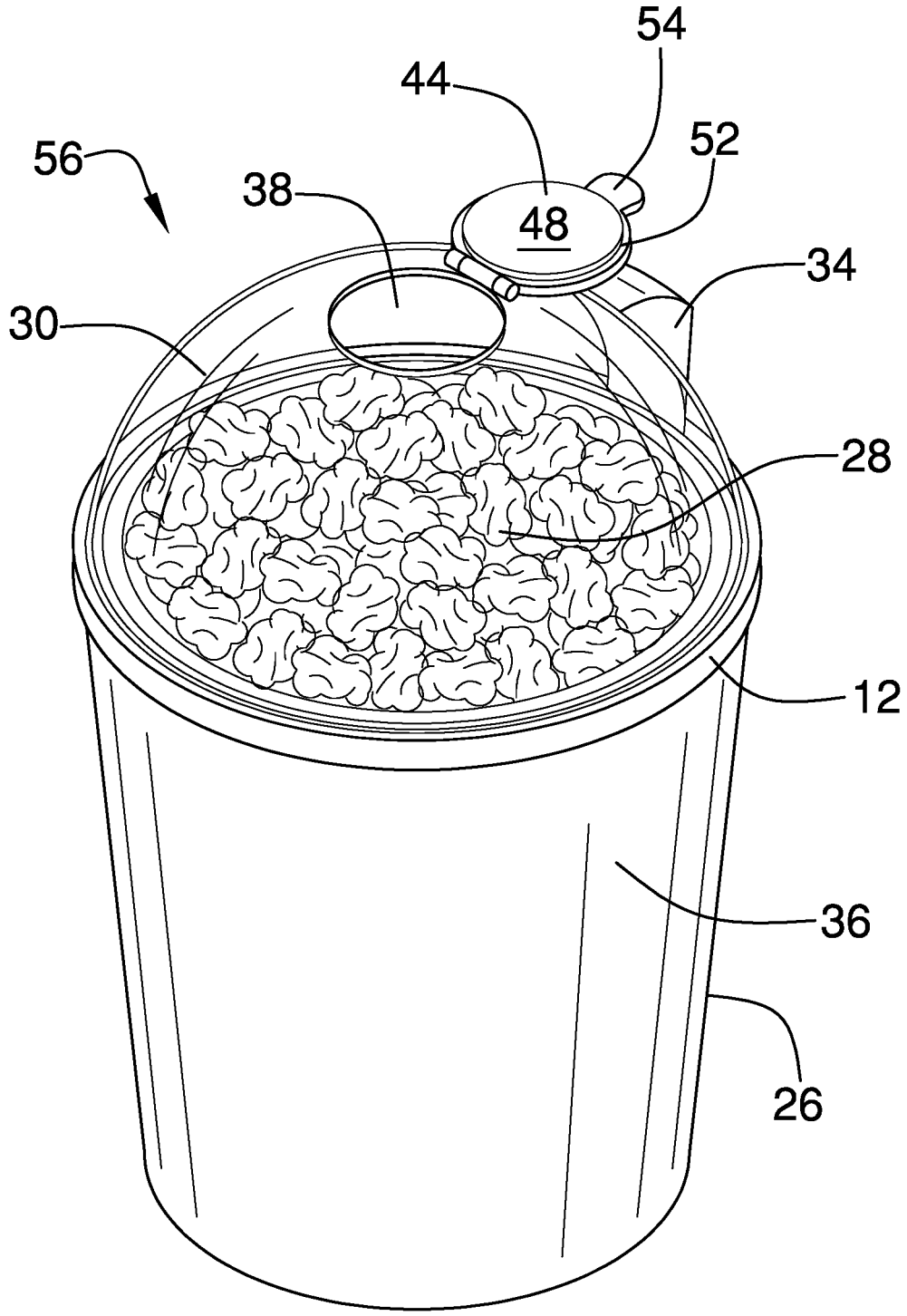
FIG. 8 is an in-use view of an embodiment of the disclosure.
Figure 9:
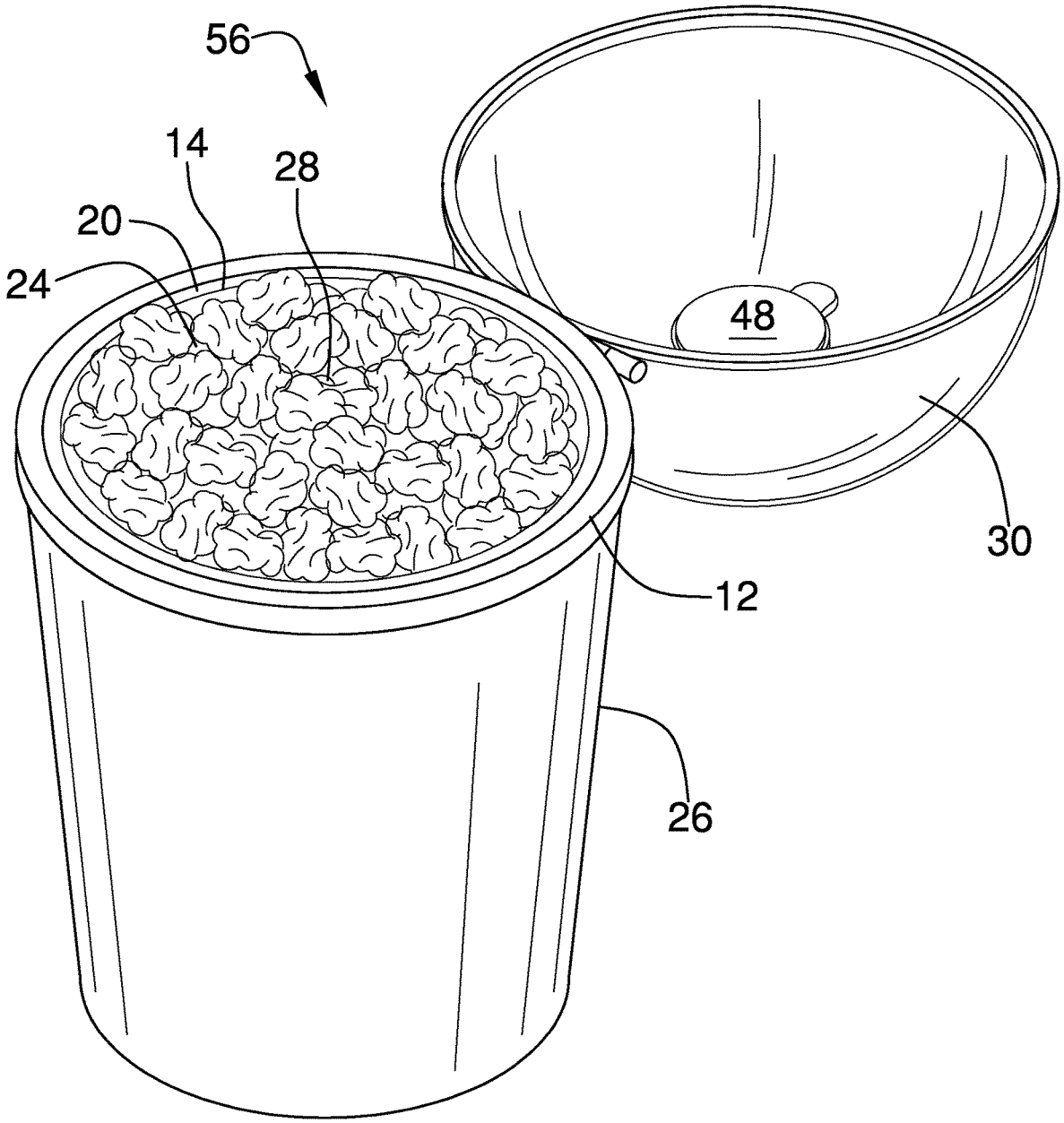
FIG. 9 is an in-use view of an embodiment of the disclosure.

As best illustrated in FIGS. 1 through 9, the hinged tub covering device 10 generally comprises a ring 12, which has a groove 14 positioned in its inner face 16, with the groove 14 extending circumferentially around the ring 12, as shown in FIGS. 3 and 6. The present invention also anticipates the groove 14 being positioned in a lower face 18 of the ring 12. The groove 14 is sized and shaped complementarily to a lip 20 that is attached to a circumference 22 of a top 24 of a container 26, as shown in FIG. 7. Such containers 26 are used for holding popcorn 28, as shown in FIG. 9, wherein the ring 12 is circular. The present invention anticipates the ring 12 being alternatively shaped, such as rectangular, oval, and the like, so as to complement other shapes of containers 26 used for holding popcorn 28. The container 26 may be of a disposable type commonly used in movie theatres, ballparks, and the like, or it may be of a reusable type, which often are used in private residences.

The groove 14 is configured for snap fit engagement with the lip 20 to removably attach the ring 12 to the container 26. A domed cover 30 is hingedly attached to the ring 12 and is selectively hingable between a closed configuration, wherein the domed cover 30 is configured to retain popcorn 28 within the container 26, and an open configuration, wherein the popcorn 28 can be added to the container 26 and wherein the popcorn 28 is accessible to a user. The domed cover 30 may be substantially transparent.

A hinge 32 is attached to and extends between the ring 12 and the domed cover 30. The hinge 32 is spring loaded so that the domed cover 30 is biased to the closed configuration. A protrusion 34 is attached to the domed cover 30 and extends from the hinge 32 toward an upper end 42 of the domed cover. The protrusion 34 is configured to engage a sidewall 36 of the container 26 to support the domed cover 30 upon hinging of the domed cover 30 to the open configuration, as shown in FIG. 9.

A cutout 38 is positioned in the upper end 42 of the domed cover 30. As shown in FIG. 8, the cutout 38 is circular but also may be alternatively shaped, such as rectangular, oval, and the like. A flap 40 is hingedly attached to the domed cover 30 and is selectively hingable between a closed position over the cutout 38, wherein the flap 40 is configured to retain the popcorn 28 within the container 26, and an open position, wherein the cutout 38 is configured for addition of a flavoring agent, such as butter, to the container 26.

The flap 40 comprises a disc 44, which is resiliently compressible. A recess 46 extends into a lower facet 48 of the disc 44 and circumferentially around a perimeter 50 of the disc 44, thereby defining a ridge 52. The disc 44 is partially insertable into the cutout 38 with the ridge 52 engaging the upper end 42 of the domed cover 30 to sealably close the cutout 38. A tab 54 is attached to and extends from the flap 40. The tab 54 is configured to be grasped in digits of a hand of the user, positioning the user to selectively pull on the tab 54 to hinge the flap 40 to the open position.

Another embodiment of the invention includes a hinged tub covering system 56, which comprises a container 26 having a lip 20 attached to its circumference 22. The hinged tub covering system 56 also comprises a hinged tub covering device 10, as described in the specification above. A ring 12 of the hinged tub covering device 10 is attached to the container 26 by means of the lip 20 being in snap fit engagement with a groove 14 in the ring 12. The hinged tub covering system 56 also may include popcorn 28 in the container 26.

In use, the domed cover 30 is attached to a container 26. The domed cover 30 is hinged open, popcorn 28 is added to the container 26, and the domed cover 30 is hinged closed. The flap 40 is hinged open to add butter to the container 26 and then it is snapped closed. The container 26 of popcorn 28 then can be carried without spilling the popcorn 28, which is a common occurrence when using a container 26 not fitted with a hinged tub covering device 10. Spilled popcorn 28 increases cleanup requirements for staff and can present a slipping hazard. The ring 12 and the domed cover 30 can be detached from the container 26 and can serve as a bowl 58 for portioning out the popcorn 28 to multiple users, a convenience which also serves to limit spillage of the popcorn 28. Another use of the hinged tub covering device 10 is in transporting leftover popcorn 28 in a manner in which it will not be spilled.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A pivoting tub covering device comprising:

a ring;

a groove positioned in an inner face of, and extending circumferentially around, the ring, the groove being sized and shaped complementarily to a lip attached to a circumference of a top of a container, wherein the groove is configured for snap fit engagement with the lip for removably attaching the ring to the container;

a domed cover pivotally attached to the ring, such that the domed cover is selectively pivotable between a closed configuration, wherein the domed cover is configured for retaining popcorn within the container, and an open configuration, wherein the popcorn can be added to the container and wherein the popcorn is accessible to a user;

a cutout positioned in an upper end of the domed cover;

a flap pivotally attached to the domed cover, such that the flap is selectively pivotable between a closed position over the cutout, wherein the flap is configured for retaining the popcorn within the container, and an open position, wherein the cutout is configured for addition of a flavoring agent to the container;

a hinge attached to and extending between the ring and the domed cover; and a protrusion attached to the domed cover aligned with the hinge and extending from the hinge toward the upper end of the domed cover, wherein the protrusion is configured for engaging a sidewall of the container for supporting the domed cover upon hinging of the domed cover to the open configuration, the protrusion having an outwardly facing surface relative to the domed cover, the outwardly facing surface of the protrusion being concavely arcuate and extending upwardly from the hinge such that the outwardly facing surface is configured to extend linearly away from the sidewall of the container in linearly alignment with an outer surface of the sidewall of the container when the domed cover is in the closed position, the outwardly facing surface of the protrusion further being concavely arcuate such that the outwardly facing surface of the protrusion is configured to be complementary to a curvature of an abutting portion of the sidewall of the container when the domed cover is in the open position.

2. The pivoting tub covering device of claim 1, wherein the ring is circular.

3. The pivoting tub covering device of claim 1, wherein the domed cover is substantially transparent.

4. The pivoting tub covering device of claim 1, wherein the cutout is circular.

5. The pivoting tub covering device of claim 1, wherein the flap comprises:

a disc, the disc being resiliently compressible; and a recess extending into a lower facet of the disc and extending circumferentially around a perimeter of the disc defining a ridge, such that the disc is partially insertable into the cutout with the ridge engaging the upper end of the domed cover for sealably closing the cutout.

6. The pivoting tub covering device of claim 1, wherein the hinge is spring loaded, such that the domed cover is biased to the closed configuration.

7. The pivoting tub covering device of claim 1, further including a tab attached to and extending from the flap, wherein the tab is configured for grasping in digits of a hand of the user, positioning the user for selectively pulling on the tab for pivoting the flap to the open position.

8. A pivoting tub covering device comprising:

a ring, the ring being circular;

a groove positioned in an inner face of, and extending circumferentially around, the ring, the groove being sized and shaped complementarily to a lip attached to a circumference of a top of a container, wherein the groove is configured for snap fit engagement with the lip for removably attaching the ring to the container;

a domed cover pivotally attached to the ring, such that the domed cover is selectively pivotable between a closed configuration, wherein the domed cover is configured for retaining popcorn within the container, and an open configuration, wherein the popcorn can be added to the container and wherein the popcorn is accessible to a user, the domed cover being substantially transparent;

a cutout positioned in an upper end of the domed cover, the cutout being circular;

a flap pivotally attached to the domed cover, such that the flap is selectively pivotable between a closed position over the cutout, wherein the flap is configured for retaining the popcorn within the container, and an open position, wherein the cutout is configured for addition of a flavoring agent to the container, the flap comprising:

a disc, the disc being resiliently compressible, and a recess extending into a lower facet of the disc and extending circumferentially around a perimeter of the disc defining a ridge, such that the disc is partially insertable into the cutout with the ridge engaging the upper end of the domed cover for sealably closing the cutout;

a tab attached to and extending from the flap, wherein the tab is configured for grasping in digits of a hand of the user, positioning the user for selectively pulling on the tab for pivoting the flap to an open position;

a hinge attached to and extending between the ring and the domed cover, the hinge being spring loaded, such that the domed cover is biased to the closed configuration; and a protrusion attached to the domed cover aligned with the hinge and extending from the hinge toward the upper end of the domed cover, wherein the protrusion is configured for engaging a sidewall of the container for supporting the domed cover upon pivoting of the domed cover to the open configuration, the protrusion having an outwardly facing surface relative to the domed cover, the outwardly facing surface of the protrusion being concavely arcuate and extending upwardly from the hinge such that the outwardly facing surface is configured to extend linearly away from the sidewall of the container in linearly alignment with an outer surface of the sidewall of the container when the domed cover is in the closed position, the outwardly facing surface of the protrusion further being concavely arcuate such that the outwardly facing surface of the protrusion is configured to be complementary to a curvature of an abutting portion of the sidewall of the container when the domed cover is in the open position.

9. The pivoting tub covering system of claim 8, further including popcorn being positioned in the container.

* * * * *